United States Patent [19]

Yanagihara et al.

[11] Patent Number: 4,976,097

[45] Date of Patent: Dec. 11, 1990

[54] LEVEL-DYEABLE MIX-SPUN FALSE-TWISTED YARN

[75] Inventors: Masaaki Yanagihara, Iyo; Katsutoshi Taniguchi, Matsuyama; Masakazu Fujita, Ikoma, all of Japan

[73] Assignee: Teijin Limited, Osaka, Japan

[21] Appl. No.: 400,115

[22] PCT Filed: Dec. 14, 1988

[86] PCT No.: PCT/JP88/01267

§ 371 Date: Aug. 15, 1989

§ 102(e) Date: Aug. 15, 1989

[87] PCT Pub. No.: WO89/05877

PCT Pub. Date: Jun. 29, 1989

[30] Foreign Application Priority Data

Dec. 23, 1987 [JP] Japan ..... 62-323685

[51] Int. Cl.[5] ..... D02G 3/36

[52] U.S. Cl. ..... 57/208; 57/228; 57/245

[58] Field of Search ..... 57/206, 207, 208, 284, 57/288, 908, 245, 248, 228

[56] References Cited

U.S. PATENT DOCUMENTS

| | | | |
|---|---|---|---|
| 1,944,378 | 1/1934 | Thenoz | 57/248 X |
| 3,691,750 | 9/1972 | Waters | 57/288 X |
| 3,851,457 | 12/1974 | Waters | 57/288 X |
| 4,058,968 | 11/1977 | Benson | 57/208 X |
| 4,103,481 | 8/1978 | Vukoje | 57/288 X |
| 4,219,997 | 9/1980 | Hatcher | 57/245 |
| 4,801,503 | 1/1989 | Jennings | 57/248 X |

FOREIGN PATENT DOCUMENTS

| | | |
|---|---|---|
| 6327 | 5/1972 | Japan . |
| 47-18060 | 5/1972 | Japan . |
| 84951 | 7/1976 | Japan . |
| 11585 | 4/1978 | Japan . |

*Primary Examiner*—Joseph J. Hail, III

*Attorney, Agent, or Firm*—Burgess, Ryan & Wayne

[57] ABSTRACT

Disclosed is a level-dyeable mixed false-twisted filament yarn composed of larger denier multifilaments (1) having a denier of 1 to 2.5 and smaller denier multifilaments (2) having a denier of 0.6 or less, which is characterized in that (a) the yarn comprises entangled portions (I) thereof whereat the larger denier filaments and the smaller denier filaments are entangled with one another and opened portions (II) thereof comprising a core composed of the larger denier filaments and a covering composed of the smaller denier filaments, (b) in the coverings of the opened portions, net-like parts thereof are formed by the smaller denier filaments extending obliquely to the longitudinal axis of the yarn and intersecting one another, and scattered therein, (c) the length $L_1$ of the opened portions is longer than the length $L_2$ of the entangled portions, and (d) in a unit length of the false-twisted filament yarn, the length of the smaller denier filaments is 5 to 12% longer than the length of the larger denier filaments, based on the length of the larger denier filaments.

7 Claims, 3 Drawing Sheets

LEVEL-DYEABLE MIX-SPUN FALSE-TWISTED YARN

TECHNICAL FIELD

The present invention relates to a level-dyeable mixed false-twisted filament yarn. More particularly, the present invention relates to a level-dyeable mixed false-twisted filament yarn which is suitable for the manufacture of a fabric having a very soft touch and a good bulkiness, and further, exhibiting a high resilience and a good level of dyeability.

BACKGROUND ART

As the conventional false-twisted filament yarn suitable for the production of a fabric having a combination of a soft touch and an appropriate resilience, a mixed false-twisted filament yarn having entangled portions and open portions thereof appearing intermittently in the longitudinal direction, which is prepared by blending and entangling at least two types of filaments having different denier by a pneumatic blending apparatus such as a Taslan nozzle or an interlacing nozzle, is known from, for example, Japanese Examined Patent Publication No. 47-18060.

The entangled portions of this type of false-twisted filament yarn are formed intermittently along the longitudinal direction, and larger denier filaments form cores and smaller denier filaments form coverings (sheaths) in these portions.

In this type of mixed false-twisted filament yarn, a bundling property is given by the entangled portions thereof and a bulkiness is imparted by opened portions formed between the entangled portions. The touch of a fabric obtained from this false-twisted filament yarn is soft, but the resilience is relatively low.

In a mixed false-twisted filament yarn obtained by blending a plurality of crimped multifilaments having a different denier by a pneumatic blending apparatus, the larger denier filaments and the smaller denier filaments in the interior of the yarn are easily separated from each other, and in the opened portions of this yarn, the opened smaller denier filaments cover a core composed mainly of the larger-denier filaments in a state wherein the smaller-denier filaments extend substantially in parallel to the longitudinal axis of the yarn. Accordingly, it is difficult to uniformly cover the core composed of the larger-denier filaments with the smaller-denier filaments, and therefore, if a fabric formed from the false-twisted filament yarn is dyed, an uneven dyeing occurs because of the uneven distribution of the larger-denier filaments and smaller-denier filaments, especially smaller denier filaments, and an uneven coloration of the dyed fabric is obtained.

To eliminate the above defect of the conventional mixed false-twisted filament yarn, the present inventors changed the denier in the larger-denier filaments and/or smaller-denier filaments constituting the false-twisted yarn, but found it was difficult to obtain a mixed false-twisted filament yarn which can be converted to a fabric having a very soft touch, a good bulkiness, a sufficient resilience, a good crease recovery, and a uniform appearance, even after dyeing.

DISCLOSURE OF THE INVENTION

An object of the present invention is to provide a level-dyeable mixed false-twisted filament yarn suitable for the production of a fabric having a very soft touch and a good bulkiness, and exhibiting a satisfactory resilience, a good crease recovery, and an excellent level dyeability, and thus providing a uniform dyed appearance, wi&h no dyeing unevenness, and a good touch.

To realize the above object, the present inventors carried out research into the subject, and as a result, found that, in the conventional mixed false-twisted filament yarn, since at least two types of constituent filaments are blended by a two-feed method, the core composed mainly of larger-denier filaments cannot be uniformly covered with smaller-denier filaments, and thus unevenly dyed and spinkly colored, fine portions are unavoidably formed in the fabric prepared from the false-twisted filament yarn.

The present inventors carried out further research based on this finding, and as a result, found that when at least two types of filament yarns having a different ultimate elongation are false-twisted in the entangled state, if the difference in the elongation and the false-twisting condition are maintained within specific ranges, a false-twisted filament yarn is obtained in which the entangled portions thereof where constituent filaments are substantially tightly entangled and the opened portions thereof where the smaller-denier filaments having fine crimps cover the larger-denier filaments in the net-like form, are alternately formed along the longitudinal direction of the yarn, and this mixed false-twisted filament yarn is suitable for forming a fabric having a very soft touch and a good bulkiness, and exhibiting an appropriate resilience, a good crease recovery, and a good level of dyeability, and thus shows a uniform colored appearance and has a good feel, and the present invention was completed based on this finding.

More specifically, in accordance with the present invention, there is provided a false twisted filament yarn comprising at least two types of multifilaments having a different denier and ultimate elongation, and simultaneously satisfying the requirements (i) and (ii):

(i) the larger-denier filaments having a denier of 1 to 2.5, and (ii) the smaller denier filaments having fine crimps and a denier of 0.6 or less, and characterized in that the entangled portions and the opened portions in the yarn are alternately formed along the longitudinal direction of the yarn,

[A] said opened portions each comprising a core composed mainly of the larger-denier filaments and a covering composed mainly of opened smaller-denier filaments, which covering has net-like parts thereof formed by the smaller-denier filaments extending obliquely to the longitudinal axis of the yarn and intersecting one another, and scattered in the covering,

[B] the length ($L_1$) of the open portions being longer than the length ($L_2$) of the entangled portions, and

[C] in a unit length of the false-twisted filament yarn, the smaller-denier filaments being longer than the larger-denier filaments; this difference in length being 5 to 12% based on the length of the larger-denier filaments.

BEST MODE OF CARRYING OUT THE INVENTION

The false-twisted filament yarn of the present invention will now be described in detail with reference to the accompanying drawings.

Figure 1:
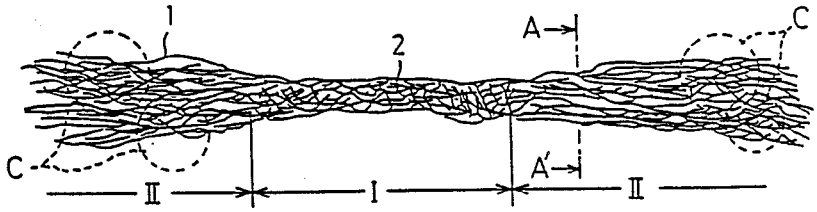
FIG. 1 is a side view illustrating level-dyeable mixed false-twisted filament yarn of the present invention.
Figure 2:
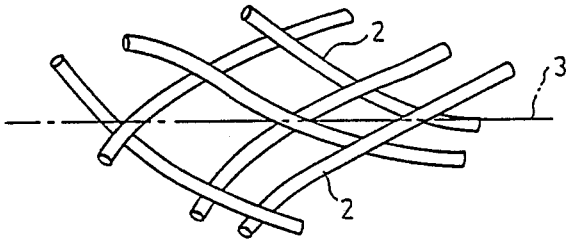
FIG. 2 is an explanatory view illustrating an example of the construction of the net-like parts scattered in the opened portion of the level-dyeable mixed false-twisted filament yarn of the present invention.
Figure 3:
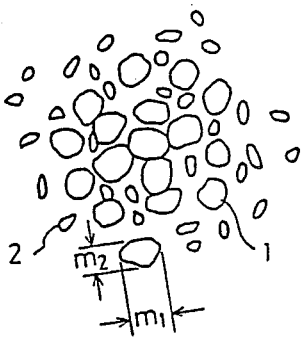
FIG. 3 is a view showing a cross-sectional profile taken along the line A—A', of the level-dyeable mixed false-twisted filament yarn of the present invention shown in FIG. 1.
Figure 4A:
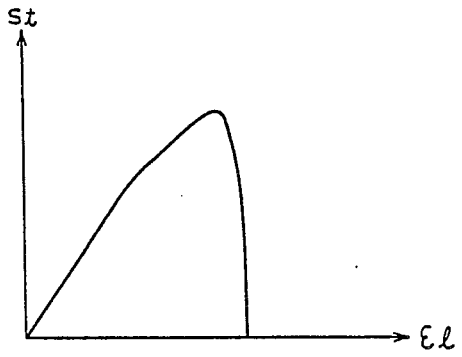
FIG. 4(A) is a stress (st)-elongation (εl) curve of an embodiment of the level-dyeable mixed false-twisted filament yarn of the present invention.
Figure 4B:
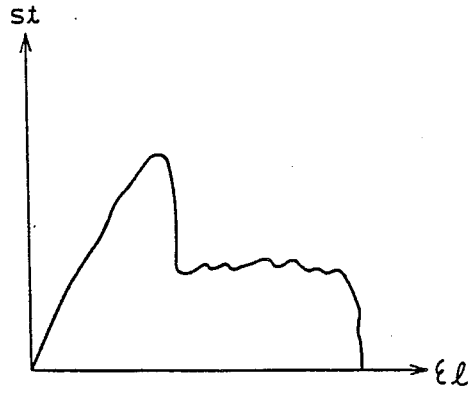
FIG. 4(B) is a stress (st)-elongation (εl) curve of an embodiment of the conventional two-layer false-twisted filament yarn; and, FIG. 5 is an explanatory view illustrating an embodiment of the apparatus for the production of the level-dyeable mixed false-twisted filament yarn of the present invention.
Figure 5:
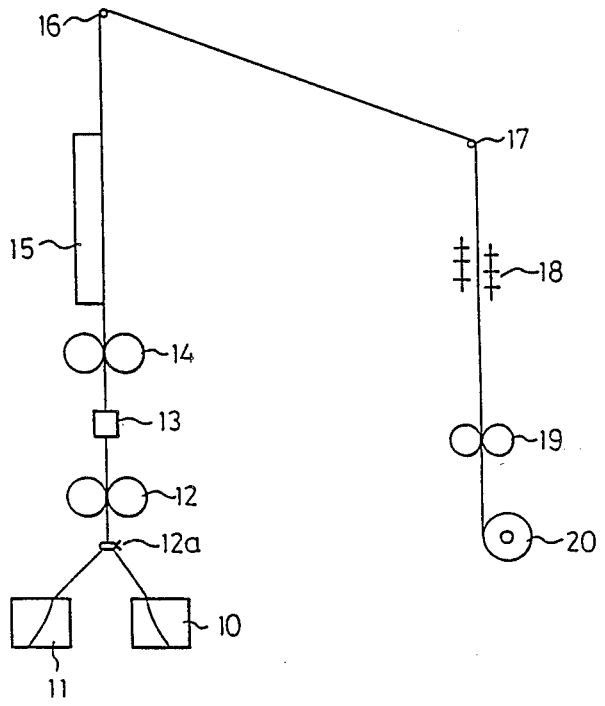

FIG. 1 is a side view illustrating one embodiment of the false-twisted filament yarn of the present invention; FIG. 2 is an enlarged view illustrating the net-like part C shown in FIG. 1; FIG. 3 is a cross-sectional view of the false-twisted filament yarn of the present invention, taken along the line A–A, in FIG. 1; FIG. 4(A) and FIG. 4(B) are stress (st)-elongation (εl) curves of the false-twisted filament yarn of the present invention and the conventional two-layer false-twisted filament yarn; and, FIG. 5 is a diagram illustrating one embodiment of the apparatus for the production of the false-twisted filament yarn of the present invention.

In the false-twisted filament yarn shown in FIG. 1, I represents an entangled portion thereof and II represents an opened portion thereof. In FIGS. 1 and 3, the core of the opened portion II is composed mainly of larger-denier filaments 1 and the covering (sheath) is composed mainly of smaller-denier filaments 2.

The false-twisted filament yarn of the present invention comprises at least two types of filaments having a different denier, and as shown in FIG. 1, entangled portions I and open portions thereof II are substantially alternately formed along the longitudinal direction of the yarn.

In the entangled portion I of the false-twisted filament yarn of the present invention, the larger-denier filaments 1 and the smaller-denier filaments are mixed and tightly entangled with each other.

In the entangled portion I, in general, the yarn as a whole is compacted and the cross-sectional profile of this portion in the yarn is relatively circular, and therefore, the cross-sectional secondary moment of the portion is large, and thus the entangled portion can impart a high resilience to a fabric formed from this false-twisted filament yarn.

As shown in FIGS. 1, 2, and 3, the opened portion II adjacent to the entangled portion I comprises a core composed mainly of larger-denier filaments 1 and a covering (sheath) covering the core, and composed mainly of smaller-denier filaments 2 having fine crimps. As shown in FIG. 2, in this covering, the smaller-denier filaments 2 extend obliquely to the longitudinal axis 3 of the yarn and intersect one another to form scattered net-like parts C thereof. This opened portion II can impact high degrees of bulkiness and softness which cannot be easily imparted by the entangled portion I, to the false-twisted filament yarn and the fabric formed therefrom. The term "net-like" refers to that condition shown in FIG. 2, wherein the smaller-denier filaments 2 extend in the S-twist and Z-twist directions obliquely to the longitudinal axis 3 of the yarn and intersect one another to form a covering layer part having a net-like structure. Accordingly, the covering is stabilized by many net-like parts scattered in the covering and the core can be substantially uniformly covered.

More specifically, in the opened portion II, the core composed mainly of the larger-denier filaments 1 is substantially uniformly and stably covered with a number of net-like parts of the covering composed mainly of the smaller-denier filaments 2, and therefore, even when the fabric obtained from this false-twisted filament yarn is dyed, an uneven coloring derived from an uneven distribution of larger-denier filaments and smaller-denier filaments does not occur and a uniform appearance is obtained.

It is sufficient if 7 to 8 net-like parts are present on the average in each opened portion II.

The false-twisted filament yarn having this opened portion II can be produced only by false-twisting a plurality of types of multi-filaments having a different ultimate elongation in the entangled state, under the specific false-twisting conditions described hereinafter.

In the present invention, the length ($L_1$) of the opened portion (II) must be longer than the length ($L_2$) of the entangled portion I.

If the length ($L_1$) of the opened portion is shorter than the length ($L_2$) of the entangled portion I, it is impossible to impart a desired bulkiness and softness to the finally obtained fabric.

The respective multifilaments, from which the false-twisted filament yarn of the present invention is constituted, should simultaneously satisfy the following two requirements (i) and (ii).

(i) The denier of the larger-denier filaments is 1 to 2.5, preferably 1.2 to 2.2.

(ii) The denier of the smaller-denier filaments is 0.6 or less, preferably 0.3 to 0.5.

More specifically, as shown in FIGS. 1, 2 and 3, in the opened portion II, the core serves mainly as a tension bearer. and when the larger-denier filaments 1 constituting mainly the core have the above-mentioned denier (i), the larger denier filaments 1 impart a sufficient resilience to the obtained fabric in combination with the functions of the entangled portion, and at the same time, a good crease recovery is imparted thereto.

When the smaller-denier filaments constituting mainly the covering (sheath) of the opened portion (II) have the above-mentioned denier (ii), in the opened portion II of the false-twisted filament yarn of the present invention, it becomes possible to uniformly cover the core with a stabilized covering layer having a number of net-like parts, and a very soft tough and a good bulkiness can be given to a fabric produced from the false-twisted filament yarn.

In the false-twisted filament yarn of the present invention, in a unit length of the yarn, the smaller-denier filaments 2 must be longer that the larger-denier filaments 1 and the difference in length between the smaller-denier filaments 2 and the larger-denier filaments 1 in the unit length of the yarn should be 5 to 12%, preferably 8 to 10%, based on the length of the larger-denier filaments.

Note, the filament length difference referred to in the present invention is measured according to the method described in Japanese Examined Patent Publication No. 58-18457.

In the false-twisted filament yarn in which the filament length difference is smaller than 5%. the covering having net-like parts scattered therein is not easily formed in the opened portion II. If the filament length difference is larger than 12%, alternately twisted wrapped portions are readily formed in the resultant false-twisted filament yarn. Accordingly, in each case, fabrics obtained from the above-mentioned types of false-twisted filaments yarn will exhibit an unsatisfactory softness.

The stress (st)-elongation ($\epsilon$) curve of the false-twisted filament yarn has a profile as shown in FIG. 4(A), which is different from the profile of the stress (st)-elongation ($\epsilon$) curve, shown in FIG. 4(B) of the conventional two-layer yarn, i.e., the above-mentioned mixed false-twisted filament yarn.

In the false-twisted filament yarn of the present invention, preferably the layer-denier filaments and smaller-denier filaments simultaneously satisfy the following requirements (iii) and (iv). In this case, a high resilience, a good crease recovery and an excellent softness can be imparted to the obtained fabric, and simultaneously, an improved smooth feeling can be imparted. (iii) In the larger-denier filaments, (1) the degree of flatness of the cross sectional profile thereof is 1.5 or less, especially preferably 1.1 to 1.4, and (2) the number of the filaments is 15 to 50, especially preferably 20 to 40.

(iv) In the smaller-denier filaments, (1) the degree of flatness of the cross-sectional profile is larger than that of the larger-denier filaments, preferably 1.6 to 2.0 times the degree of flatness of the cross-sectional profile of the larger-denier filaments, and (2) the number of the filaments is at least 100, preferably 120 to 160.

The term "degree of flatness of cross-sectional profile" of the filament refers to a ratio ($m_1/m_2$) of the length ($m_1$) of the major axis of the flat cross-sectional profile to the length ($m_2$) of the minor axis thereof, and the closer to 1 the degree of flatness, the closer to a true circle the cross-sectional profile of the filament.

In general, as the filament cross-sectional profile is more flattened, the cross-sectional secondary moment of the filament becomes smaller and the filament is more easily deformed under an external force.

Accordingly, in the false-twisted filament yarn of the present invention, when the larger-denier filaments simultaneously satisfy the requirements (iii) (1) and (iii)-(2), the larger-denier filaments constituting mainly the core and serving as the tension bearer have a circular cross-sectional profile or a shape close thereto, and the resilience and crease recovery of a fabric prepared from this processed filament yarn are further improved.

When the smaller denier filaments simultaneously satisfy the requirements (iv)-(1) and (iv)-(2), the cross-sectional profile of the smaller denier filaments constituting mainly the covering is flattened, and the softness of a fabric prepared from this processed yarn is further improved, and at the same time, a smooth touch can be imparted to the processed filament yarn.

In the false-twisted filament yarn of the present invention, from the viewpoint of the balance between the entangled portions I and the opened portions II, preferably the distribution number of the entangled portions is 50 to 70 per meter and the ratio ($L_1/L_2$) of the length ($L_1$) of the opened portions II to the length ($L_2$) of the entangled portions I is larger than 1, especially 1.5 to 4.0.

Moreover, in the opened portion II, preferably the wavelength of crimps on the smaller denier filaments 2 is 0.2 to 0.8 mm. In this case, the soft touch of a fabric prepared from this processed filament yarn can be further improved.

Note, the wavelength of crimps on the smaller-denier filaments refers to a distance between the peaks and peaks or troughs and troughs of adjacent crimps on the smaller-denier filaments in the opened portion, measured from a photo at 36 magnifications taken by an optical microscope with respect to the side face of the processed filament yarn.

In the false-twisted filament yarn of the present invention, preferably the ratio ($f_1/f_2$) of the number ($f_1$) of the larger denier filaments to the number ($f_2$) of the smaller denier filaments is from 1/10 to 1/2. Also, preferably the false-twisted filament yarn of the present invention has a Young's modulus of 300 to 500 kg/mm$^2$, whereby a fabric prepared from this false-twisted filament yarn will have a further improved resilience.

The above-mentioned false-twisted filament yarn of the present invention is suitably used for the production of high-density woven fabrics for sports wear and casual wear, and thin woven fabrics for blouses and the like. In these applications, the total denier of the false-twisted filament yarn is preferably 130 or less, especially 60 to 120.

Preferably, the crimp ratio (TC) of the false-twisted filament yarn of the present invention is 4 to 15%, especially 7 to 12%.

If the crimp ratio (TC) of the false-twisted filament yarn is lower than 4%, the bulkiness of the resultant high-density woven fabric is often unsatisfactory, and if the crimp ratio (CT) of the false-twisted filament yarn exceeds 15%, the resultant high-density woven fabric is soft but the feed of the fabric is not properly resilient.

Any type of thermoplastic polymers can be used as the polymer for formation of the false-twisted filament yarn of the present invention, but preferably a polyester, especially polyethylene terephthalate, is used.

Filaments to which various functions have been imparted can be used as the smaller denier filaments and/or larger denier filaments constituting the processed filament yarn of the present invention, and the use of such filaments is preferred. Examples of such functions will now be described.

(1) Antistatic Property

A polymer containing an insoluble polyoxyalkylene glycol and a metal salt of an alkyl-sulfonic acid, represented by the general formula $RSO_3M$ (in which R stands for an alkyl group having at least 8 carbon atoms and M stands for an alkali metal), is used as the filament-forming polymer. Preferably, the content of the polyoxyalkylene glycol in the polymer is 0.1 to 10% by weight and the content of the metal salt of the alkyl-sulfonic acid is 0.2 to 10% by weight, and especially preferably, the filaments are formed to have a hollow structure.

(2) Electroconductivity

A core/sheath composite filament containing a conducting agent in the core, as disclosed in, for example, Japanese Examined Patent Publication No. 60-21553, is used.

(3) Water-Absorbing Property

A filament formed from a polymer containing a fine pore-forming agent known from Japanese Unexamined Patent Publication No. 56-20612, in which fine pores are arranged along the longitudinal direction, the diameter of the fine pores is 0.01 to 3 μm, and the length of the fine pores is smaller than 50 times the diameter of the fine pores, is preferably used. To improve the water-absorbing property, preferably the filament has a hollow structure and the fine pores are communicated with the hollow portion.

(4) Dyeing Sharpness

A filament prepared from a polymer containing a fine pore-forming agent known from Japanese Unexamined Patent Publication No. 54-120728 or Japanese Unexamined Patent Publication No. 57-25414, in which fine pores are arranged along the longitudinal direction and the diameter of the fine pores is 0.1 to 0.3 $\mu$, is preferably used.

(5) Easy Dyeability

A filament formed from a polymer containing about 1 to about 10 mole% of a dyeing propertY-improver, for example, 5-sulfoisophthalic acid component, copolymerized with recurring units of the polymer, is used.

Furthermore, an easily dyeable filament disclosed in Japanese Unexamined Patent Publication No. 57-199814 or the like can be used.

A mixed filament yarn consisting of the filaments having an improved dyeability and filaments having a different dyeability, for example, a mixed filament yarn consisting of cation dye-dyeable filaments having copolymerized 5-sulfoisophthalic acid component, and a disperse dye-dyeable filament, can be used.

(Elasticity)

A filament formed from an elastic polymer, for example, polybutylene terephthalate, is used. Preferably, this elastic filament is used as the larger denier filament.

Note, these functional filaments are mentioned by way of example, and the filaments that can be used are not limited to those exemplified above.

The above-mentioned false-twisted filament yarn can be produced by using highly oriented filaments (USY) and ultra-fine filaments (SFD), which simultaneously satisfy the following requirements (1) through (3), according to a process illustrated, for example, in FIG. 5.

(1) USY (i) Birefringence ($\Delta n$): 0.07 to 0.1 (preferably 0.08 to 0.09)

(ii) Filament denier 1.5 to 3.4 de (preferably 1.8 to 3.0 de)

(iii) Filament number: 15 to 50, preferably 20 to 40

(2) SFD (i) Birefringence ($\Delta n$): 0.04 to 0.05 (preferably 0.042 to 0.048)

(ii) Filament denier: 0.8 de or less (preferably 0.4 to 0.7 de)

(iii) Filament number: 100 or more (preferably 120 to 160)

(3) Difference in ultimate elongation: 30 to 70% (preferably 40 to 60%)

Referring to FIG. 5, USY 10 and SFD 11 are fed through a pair of take-out rollers, and are doubled by a doubling hook 12*a*. The doubled filaments are entangled by an interlacing nozzle 13 and are false-twisted while being drawn at a draw ratio of 1.1 to 1.4 between a feed roller 14 and a delivery roller 19. The resultant false-twisted filament yarn is wound on a winder 20.

In this false-twisting process, the doubled filament yarn is passed through a heater 15 heated at a temperature of 180°C. or less (preferably 150 to 180°C.), and the yarn is bent by a guide pin 16 and a guide 17 and is rubbed by the guides 16 and 17. Then, the yarn is twisted and untwisted by a false-twisting member 18. At this step, preferably the twisting tension ($T_1$) is maintained at 50 to 60 g/100 de ( the usual twisting tension is about 40 g/100 de), and the ratio ($T_2/T_1$) of the untwisting tension ($T_2$) to the twisting tension ($T_1$) is adjusted from 0.95 to 1.15.

Where the heater temperature is higher than 180° C. or the yarn is not scratched by the guides 16 and 17, the resultant false-twisted filament yarn forms a substantially alternately wrapped false-twisted filament yarn different from the processed yarn of the present invention.

When the ratio ($T_2/T_1$) is lower than 0.95, the opened portion II is not easily formed in the resultant processed yarn, and when the ratio ($T_2/T_1$) exceeds 1.15, it becomes difficult to substantially retain the entangled portion I in the processed yarn.

In this false-twisting process, preferably a frictional false-twisting member capable of a high-speed processing is used as the false-twisting member 18.

Note, the "frictional step" is not limited to rubbing by the guides 16 and 17, and it is readily understood that it is sufficient if a corresponding rubbing occurs between the heater 15 and the false-twisting member 18.

False-twisting processes resembling the above-mentioned false-twisting process in the used filamentary yarn are disclosed in Japanese Unexamined Patent Publication No. 59-173322 and Japanese Unexamined Patent Publication No. 61-174436.

The false-twisted filament yarns obtained according to these conventional false-twisting processed disclosed in the above-mentioned patent publications are merely alternately twisted two-layer yarns and are different from the false-twisted filament yarn of the present invention consisting essentially of entangled portions and opened portions.

In the false-twisting processes disclosed in the above-mentioned patent publications, a temperature higher than 200° C., which is much higher than the false-twisting temperature (false-twisting heater temperature) necessary for obtaining the false-twisted filament yarn of the present invention, is adopted, and it is not taught that, by adopting a low heater temperature and rubbing the yarn coming from the heater as in the present invention, the ratio ($T_2/T_1$) is controlled within the range of from 0.95 to 1.15 while maintaining the twisting tension ($T_1$) at a high level.

Namely, these patent publications do not recognize that a processed yarn having entangled portions and opened portions (opened portions having net-like parts where smaller denier filaments intersect one another) appearing alternately, which is quite different from the two-layer wrapped yarn, can be obtained by performing the preliminary entanglement and adopting the special processing conditions.

The following functions and effects are obtained by the presence of the entangled portion I and opened portion II and the use of the specific filaments.

Entangled Portion I

The constituent filaments are tightly entangled with one another, and thus the processed yarn is a whole is compact and the cross-sectional profile of the yarn is relatively close to a circular shape. Accordingly, the cross-sectional secondary moment is large and a sufficient resilience can be imparted to a fabric obtained from this processed yarn. Furthermore, at the weaving step, the processed yarn can be subjected in an untwisted and unsized state to a water jet loom.

Opened Portion II

The core composed mainly of larger-denier filaments is covered with the covering composed of smaller denier filaments having fine crimps, and the smaller denier filaments of the covering extend obliquely to the yarn axis and intersect one another to form net-like parts. Since a plurality of these net-like parts are scattered in the opened portion, the covering is stabilized and the core is substantially uniformly covered. Therefore, this processed yarn is uniform and has a soft touch, and the dyeability is uniform. Accordingly, dyeing unevenness of a dyeing product of a fabric obtained from this processed yarn seldom occurs.

Use of Specific Filaments

The characteristics of the processed yarn are controlled by using filaments having the above-mentioned deniers and adjusting the difference of the length per unit length of the processed yarn between the larger denier filaments and the smaller denier filaments, and an excellent resilience and crease recovery as well as a predetermined softness can be imparted to a fabric obtained from this processed yarn.

In the false-twisted filament yarn of the present invention, by a generic combination of the above-mentioned functions and effects by the presence of the entangled portion I and opened portion II and the use of specific filaments, an expectedly excellent softness, a good soft touch, a good crease recovery, an excellent bulkiness, and an excellent resilience can be imparted to the resultant processed filament yarn and the fabric obtained from the processed yarn.

Moreover, the processed yarn of the present invention and the fabric obtained therefrom have a uniform dyeability, and color unevenness in dyed products does not occur or is reduced.

EXAMPLES

The present invention will now be described in detail with reference to the following examples.

In the examples, the frictional charge voltage, dust adherence, and dust-removing property of the false-twisted filament yarn fabric were measured by the following methods.

(1) Frictional Charge Voltage (i) Apparatus and Material

A rotary drum type frictional charge quantity-measuring apparatus (rotary static tester), an oscilloscope, and a rubbing cloth: 30/- cotton broadcloth, scoured, bleached, unsized and finished.

(ii) Preparation of Test Pieces

Test pieces for roll-in tsst:

3.8 cm × 3.0 cm

Test pieces for metal frame test:

4.0 cm × 8.0 cm

For each test, three test pieces cut in the longitudinal direction were sampled, and fabric pieces of 2.5 cm x 14.0 cm cut in the longitudinal direction were sampled from the cotton broadcloth (30/—) as the rubbing cloth.

(iii) Test Procedures (1) Moisture Conditioning

The test pieces were allowed to stand in a desiccator maintained at a relative humidity of 65±2% for one day and night.

(2) Atmosphere in measurement room:

20±2°C. and 65±2% RH (3) Pile number of test piece: 1

(4) Rotation number of drum: 700 rpm (5) Charging equilibrium time: 1 minute (6) Contact load: 600 g One test piece was attached to the rotary drum of the rotary static tester so that the front surface thereof faced upward, and one rubbing cloth was attached to clips on both the ends of the lower portion of the tester at the position falling in contact with the test piece in parallel to the test piece, and a load of 600 g was imposed thereon. In the tester, the recorder (5 cm/min), the rotary drum, and the oscilloscope were operated in this order, and when the charging equilibrium was reached, the frictional charge voltage (V) and extreme values (±,—) were read and mean values obtained with respect to the three test pieces were calculated (to 10 integral places).

In connection with the relationship between the antistatic effect and the frictional charge voltage, an antistatic effect is obtained if the frictional charge voltage is about 2000 V or less (preferably 1000 V or less).

(2) Dust Adherence

The test piece was allowed to stand in a room for two weeks, and the degree of adherence of dust was organoleptically evaluated by naked eye observation. When the degree of adherence of dust was very large the test piece was ranked as class 1 to 2, and when the degree of adherence of dust was very small, the test piece was ranked as class 4 to 5; the test piece was ranked as class 3 when the degree of adherence of dust was intermediate.

(3) Dust-Removing Property

The ease of removing dust from the rest piece which had been allowed to stand in a room for two weeks was organoleptically evaluated by naked eye observation. When dust was very easily removed, the test piece was ranked as class 5 to 4, and when the removal of dust was very difficult, the test piece was ranked as class 2 to 1; the test piece was ranked as class 3 when the easier of removing dust was intermediate.

EXAMPLE 1

Polyethylene terephthalate having an intrinsic viscosity [$\eta$] of 0.64 was melt spun and ultra-fine multifilaments (SFD) of 82 de/144 fil was produced at a spinning speed of 3000 m/min, and separately, a highly oriented yarn (USY) of 50 de/24 fil was produced at a spinning speed of 4500 m/min.

These SFD and USY were false-twisted by the process disclosed in FIG. 5.

The physical properties of SFD and USY used as the starting yarns and the false-twisting conditions are shown in Table 1.

A triaxial circumscribed frictional false-twisting member (surface speed=1580 m/min) was used as the false-twisting member.

TABLE 1

| Filaments | | | | | False-Twisting Conditions | | | | | |
|---|---|---|---|---|---|---|---|---|---|---|
| SFD | | USY | | Difference | Number of entanglements | Heater | | | Processing | Material roughness and diameter of guides |
| Δn | Ultimate elongation | Δn | Ultimate elongation | elongation (%) | (per meter) | temperature (°C.) | Draw ratio | $T_2/T_1$ | speed (m/min) | 16 and 17 |
| 0.045 | 135% | 0.086 | 77% | 58 | 60 | 170 | 1.35 | 1.06 | 600 | made from titanium, 0.2 to 1.0S, 10 mm in diameter |

When the result false-twisted filament yarn of 105 de/168 fil was observed by a microscope, it was found that the filament yarn had substantially a as shown in FIG. 1, in which entangled portions I opened portions II were alternately arranged. A number of net-like parts were scattered in the covering of the opened portion II.

The physical of the resultant false-twisted filament shown in Table 2.

TABLE 2

| Larger-denier filaments | | Smaller-denier filaments | | Difference in | | | Number of | | Crimp wave- |
|---|---|---|---|---|---|---|---|---|---|
| de | Degree of flatness | de | Degree of flatness | filament length (%) | Young's modulus ($kg/mm^2$) | $L_1/L_2$ | entangled portions I (per meter) | TC (%) | length (mm) of opened portions II |
| 1.5 | 1.3 | 0.4 | 1.8 | 9.8 | 400 | 2.7 | 60 | 6.3 | 0.42 |

Note
$L_1$: length of open portions II
$L_2$: length of entangled portions I
TC: crimp ratio The section of open portion II of the obtained false-twisted yarn as shown in FIG. 3.

The stress (st)-elongation (εl) curve of the false-twisted yarn shown in FIG. 4(A)

The stress (st )-elongation (εl) curve was determined under the conditions.

Apparatus

Autograph Model DSS100 supplied by Shimazu Seisakusho

Measurement Conditions

Test length: 25 cm
Head speed: 20 cm/min
Chart speed: 40 cm/min
Stretch speed: 80%/min
Temperature and humidity: 20° C. ×65%

The above-mentioned false-twisted filament yarn was supplied in an untwisted and unsized state to a water jet loom and woven at warp density of 120 yarns/inch and a weft density of 70 yarns/inch. The resultant high-density woven fabric was dyed by customary procedures. The resultant dyed woven fabric had a uniform appearance. When the woven fabric was subjected to the organoleptic it was found that the woven fabric was very and had a good bulkiness and a satisfactory resilience.

When the crease of the resultant high-density woven fabric examined, it was found that the crease recovery was excellent.

Note the crease recovery was evaluated by the following process.

A test cloth ha an area sufficiently larger than the area of the open hand was prepared, and the portion of the test having an area almost equal to that of the open hand -- clasped with a full force (the grasping power was 30 to 40 kg) to form a clasping crease. The creased cloth was stretched twice in each of the warp dire and weft direction (at an elongation of 1% or The test cloth was expanded on a plane and the creases were stretched two to three times by the pa of the hand, and the degree of recovery of the creases was evaluated.

EXAMPLES 2 through 7 AND COMPARATIVE EXAMPLES 1 through 5

The false-twisting operation was carried out in the same manner as described in Example 1 except that the Δn, elongation, and number of the starting filament of each starting yarn, the false-twisting conditions were changed as Table 3. The results of the measurement of the properties of the resultant processed yarn and fabric are shown in Table 3.

TABLE 3

| Item | Starting Yarns | | | | | | False-Twisting Conditions | | | | False-Twisted Filament Yarn | | | |
|---|---|---|---|---|---|---|---|---|---|---|---|---|---|---|
| | SFD | | | USY | | | | | | | Thick-denier filaments | | Fine-denier filaments | |
| Example No. | Δn | Ultimate elongation (%) | number | Δn | Ultimate elongation (%) | number | Elongation difference (%) | Heater temperature | Draw ratio | $T_2/T_1$ | de | flatness | de | flatness |
| Comparative Example 1 | 0.045 | 135 | 144 | 0.09 | 70 | 20 | 65 | 170 | 1.35 | 1.04 | 3 | 1.5 | 0.4 | 1.8 |
| Example 2 | 0.045 | 135 | 144 | 0.085 | 80 | 15 | 55 | 170 | 1.35 | 1.06 | 2.5 | 1.4 | 0.4 | 1.7 |
| Example 3 | 0.045 | 135 | 144 | 0.088 | 72 | 50 | 63 | 170 | 1.35 | 1.08 | 1.0 | 1.2 | 0.4 | 1.9 |
| Comparative Example 2 | 0.044 | 140 | 100 | 0.086 | 77 | 24 | 63 | 170 | 1.35 | 1.04 | 1.5 | 1.3 | 0.7 | 1.4 |
| Comparative | 0.051 | 110 | 144 | 0.080 | 85 | 24 | 25 | 170 | 1.35 | 1.17 | 1.5 | 1.3 | 0.4 | 1.5 |

TABLE 3-continued

| | | | | | | | | | | | | | | |
|---|---|---|---|---|---|---|---|---|---|---|---|---|---|---|
| Example 3 | | | | | | | | | | | | | | |
| Example 4 | 0.045 | 120 | 144 | 0.075 | 90 | 24 | 30 | 170 | 1.35 | 1.15 | 1.5 | 1.3 | 0.4 | 1.6 |
| Example 5 | 0.043 | 140 | 144 | 0.09 | 70 | 24 | 70 | 170 | 1.35 | 0.95 | 1.5 | 1.3 | 0.4 | 2.0 |
| Comparative Example 4 | 0.038 | 170 | 144 | 0.09 | 70 | 24 | 100 | 170 | 1.35 | 0.88 | 1.5 | 1.3 | 0.4 | 2.3 |
| Comparative Example 5 | 0.045 | 135 | 144 | 0.086 | 77 | 36 | 58 | 200 | 1.30 | 0.88 | 1.5 | 1.5 | 0.4 | 2.2 |
| Example 6 | 0.043 | 140 | 144 | 0.09 | 70 | 24 | 70 | 170 | 1.35 | 0.95 | 1.5 | 1.3 | 0.4 | 2.0 |
| Example 7 | 0.046 | 130 | 144 | 0.07 | 95 | 24 | 35 | 170 | 1.35 | 1.15 | 1.5 | 1.4 | 0.4 | 1.5 |

| | False-Twisted Filament Yarn | | | | | | |
|---|---|---|---|---|---|---|---|
| Item Example No. | Difference in filament length | Entangled portion (I) | Opened portions (II) | $L_1/L_2$ | Young's modulus (kg/mm$^2$) | TC (%) | Results of evaluation of woven fabric |
| Comparative Example 1 | 10 | o | scattered net-like parts | 4.8 | 535 | 10 | good resilience but hard touch and insufficient bulkiness |
| Example 2 | 9 | o | scattered net-like parts | 3.5 | 467 | 8 | good touch and appearance |
| Example 3 | 10 | o | scattered net-like parts | 2.0 | 375 | 5 | good touch and appearance |
| Comparative Example 2 | 10 | o | scattered net-like parts | 4.1 | 400 | 13 | insufficient softness |
| Comparative Example 3 | 4 | o | no net-like parts | 4.1 | 511 | 16 | dyeing unevenness in appearance |
| Example 4 | 5 | o | scattered net-like parts | 3.5 | 460 | 13 | good touch and appearance |
| Example 5 | 12 | o | scattered netlike parts | 2.0 | 365 | 5.3 | good touch and appearance |
| Comparative Example 4 | 15 | alternately twisted yarn | | — | 320 | 3.8 | relatively insufficient softness |
| Comparative Example 5 | 12 | alternately twisted yarn | | — | 515 | 3.8 | relatively insufficient softness |
| Example 6 | 12 | o | scattered net-like parts | 2.0 | 410 | 4 | good touch and appearance |
| Example 7 | 5 | o | scattered net-like parts | 3.5 | 480 | 15 | good touch and appearance |

COMPARATIVE EXAMPLE 6

The procedures Example 1 were repeated in the same manner except in the apparatus shown in FIG. 5, the portion the feed roller 14 and the delivery roller 19 was disposed substantially linearly and the false-twist was carried out without bending the yarn by the guide 16 and 17. In this case, $T_1$ was 40 g and $T_2/T_1$ 0.62.

The resultant false-twisted filament yarn was occupied mainly by alternately twisted wrapped portions and entangled portion and the number of open portions was very small and $L_1/L_2$ was only $\frac{1}{4}$.

When a woven was prepared from this false-twisted fil and was evaluated in the same manner as in Example 1, it was found that this comparative woven fabric had a relatively high resilience, but the and bulkiness thereof were unsatisfactory.

EXAMPLE 8

The procedures Example 1 were repeated in the same manner except that SFD derived from polyethylene terephthalate polyethylene polyethylene glycol having an average molecular of 10,000 and sodium alkylsulfonate sulfonate having 14 atoms on the average was used.

Note the contents of the polyethylene glycol and sodium alkylsulfonate 1% by weight and 5% by weight, respectively.

The resultant twisted filament yarn had the structure as shown in FIG. 1, and the touch of a high-density woven fabric obtained from this false-twisted filament yarn was s soft and the woven fabric had a sufficient and an appropriate resilience When the of the woven performance of the woven fabric was evaluated, it was fond that frictional charge voltage was 1855 V the dust adherence and dust removing property 4 or 5.

For comparison, free from polyethylene glycol and sodium alkylsulfonate was used. The frictional charge voltage of the woven fabric was 3020 V and the dust adherence and dust-removing property was class 2.

COMPARATIVE EXAMPLE 7

A false-twisted filament yarn of 64 de/144 fil having a crimp ratio (TC) of 18% and a false-twisted filament yarn of 40 de/24 fil having a crimp ratio (TC) of 24% were doubled according to the process disclosed in Japanese Examined Patent Publication No. 47-18060 to prepare a mixed false-twisted filament yarn. The crimp ratio (TC) of the resultant mixed false-twisted filament yarn was 17%.

In this mixed false-twisted filament yarn, entangled portions and opened portions thereof were alternately formed, but net-like parts as shown in FIGS. 1 and 2 were not present in the opened portions When a high-density -woven fabric finally obtained from this mixed false-twisted filament yarn was dyed, a dyeing unevenness, especially a sprinkle unevenness, in color was observed.

INDUSTRIAL APPLICABILITY

The processed yarn of the present invention can be preferably used for the production of a high-density woven fabric having a good softness, a good bulkiness (swelling property), and a high resilience. Furthermore, in the processed yarn of the present invention, net-like parts are scattered in the opened portions composed of smaller denier filaments to stabilize and uniformalize the coverings, and therefore, at the weaving step even if the false-twisted filament yarn is supplied in an unsized and untwisted state to a water jet loom, weaving can be accomplished without difficulty.

We claim:

1. A level dyeable mixed false-twisted filament yarn comprising at least two types of multifilament bundles having a different denier and ultimate elongation of individual filaments, and simultaneously satisfying the requirements (i) to (iv):

(i) the large denier individual filaments have a denier of 1 to 2.5, (ii) the smaller denier individual filaments have fine crimps and a denier of 0.6 or less, (iii) the degree of flatness of the larger denier filaments is 1.5 or less and the number ($f_1$) of the larger denier filaments in the bundle thereof is 15 to 50, and (iv) the degree of flatness of the smaller denier filaments is higher than that of the larger denier filaments and the number ($f_2$) of the smaller denier filaments in the bundle thereof is at least 100, said yarn having entangled portions and opened portions alternately formed along the longitudinal direction of the yarn, (a) said opened portions each comprising a core composed mainly of the larger denier filaments and a covering composed mainly of opened smaller denier filaments extending obliquely to the longitudinal axis of the yarn and intersecting one another, and scattered in the covering, (b) the length ($L_1$) of the opened portions being longer than the length ($L_2$) of the entangled portions, and (c) in a unit length of the false-twisted filament yarn, the smaller denier filaments being longer than the larger denier filaments and this difference in length being 5 to 12% based on the length of the larger denier filaments.

2. A false-twisted filament yarn as set forth in claim 1, wherein the distribution number of the entangled portions is 50 to 70 per meter.

3. A false-twisted filament yarn as set forth in claim 1, wherein the ratio ($L_1/L_2$) of the length $L_1$ of the opened portions to the length $L_2$ of the entangled portions is in the range of from 1.5 to 4.0.

4. A false-twisted filament yarn as set forth in claim 1, wherein the wavelength of crimps of the smaller denier filaments of the opened portions is 0.2 to 0.8 mm as determined by an optical microscope photograph taken at 36 magnifications.

5. A false-twisted filament yarn as set forth in claim 1, wherein the ratio ($f_1/f_2$) of the number ($f_1$) of the larger denier filaments to the number ($f_2$) of the smaller denier filaments is in the range of from 1/10 to $\frac{1}{2}$.

6. A false-twisted filament yarn as set forth in claim 2, 3, 4 or 5, wherein the total denier of the false-twisted filament yarn is 130 or less.

7. A false-twisted filament yarn as set forth in claim 1, wherein the crimp ratio (TC) is 4 to 15%.

* * * * *